US008727019B2

(12) United States Patent
Ringgenberg

(10) Patent No.: US 8,727,019 B2
(45) Date of Patent: May 20, 2014

(54) SAFETY JOINT WITH NON-ROTATIONAL ACTUATION

(71) Applicant: Halliburton Energy Services, Inc., Houston, TX (US)

(72) Inventor: Paul D. Ringgenberg, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/771,990

(22) Filed: Feb. 20, 2013

(65) Prior Publication Data

US 2013/0233566 A1 Sep. 12, 2013

(30) Foreign Application Priority Data

Mar. 6, 2012 (WO) ..... PCT/US12/27797

(51) Int. Cl.
*E21B 23/00* (2006.01)

(52) U.S. Cl.
USPC ..... 166/377; 166/242.6; 166/301; 175/294

(58) Field of Classification Search
USPC ..... 166/338–340, 301, 377, 381, 53, 98, 166/178, 242.6, 242.7, 243; 175/294, 175/320–326, 424; 285/1–3, 33, 145.1, 285/304, 922
See application file for complete search history.

(56) References Cited

U.S. PATENT DOCUMENTS 2,026,931 A * 1/1936 Burns et al. ..... 175/294
2,202,260 A 5/1940 Osmun
2,409,811 A * 10/1946 Taylor, Jr. et al. ..... 166/125
2,626,781 A * 1/1953 Reynolds ..... 175/294
2,802,534 A 8/1957 Conrad et al.
2,819,877 A * 1/1958 Koppl ..... 175/294
2,919,900 A 1/1960 Segelhorst
2,952,482 A * 9/1960 Torres ..... 285/313
3,050,131 A * 8/1962 Siracusa et al. ..... 175/294
3,461,982 A * 8/1969 Reardon ..... 175/294
3,524,501 A 8/1970 Armstrong et al.
3,559,732 A * 2/1971 Tucker ..... 166/114
3,966,236 A * 6/1976 Vann ..... 285/39

(Continued)

FOREIGN PATENT DOCUMENTS

EP 0928361 B1 2/2004
WO WO 2010/061231 * 6/2010

OTHER PUBLICATIONS

Schlumberger Oilfield Glossary entry for "jar", accessed Jun. 4, 2013 via www.glossary.oilfield.slb.com.*

(Continued)

*Primary Examiner* — Blake Michener
(74) *Attorney, Agent, or Firm* — Smith IP Services, P.C.; Bradley A. Misley

(57) ABSTRACT

A method of releasing a safety joint in a subterranean well can include disconnecting a tubular string at the safety joint without rotation of the tubular string. A safety joint for use in a subterranean well can include sections which are separated from each other in response to a predetermined number of relative longitudinal and non-rotational displacements between the safety joint sections. Another method of releasing a safety joint in a subterranean well can include fully actuating a jar multiple times, the jar being interconnected in a same tubular string with the safety joint, and then disconnecting the tubular string at the safety joint in response to non-rotational displacement of the tubular string.

15 Claims, 5 Drawing Sheets

(56) References Cited

U.S. PATENT DOCUMENTS

| | | | | | |
|---|---|---|---|---|---|
| 4,066,282 | A | * | 1/1978 | Vann | 285/39 |
| 4,175,778 | A | * | 11/1979 | Nunez et al. | 285/3 |
| 4,452,472 | A | * | 6/1984 | Crase | 285/3 |
| 4,484,633 | A | | 11/1984 | Brandell | |
| 4,858,690 | A | | 8/1989 | Rebardi et al. | |
| 4,971,365 | A | | 11/1990 | Schultz | |
| 4,989,672 | A | | 2/1991 | Burns, Sr. et al. | |
| 5,224,547 | A | * | 7/1993 | Burns et al. | 166/301 |
| 5,242,201 | A | * | 9/1993 | Beeman | 294/86.17 |
| 5,526,888 | A | * | 6/1996 | Gazewood | 175/320 |
| 5,695,009 | A | * | 12/1997 | Hipp | 166/196 |
| 5,718,291 | A | * | 2/1998 | Lorgen et al. | 166/377 |
| 5,810,088 | A | * | 9/1998 | Lamirand et al. | 166/377 |
| 5,984,029 | A | * | 11/1999 | Griffin et al. | 175/321 |
| 6,131,953 | A | * | 10/2000 | Connell et al. | 285/3 |
| 6,318,470 | B1 | * | 11/2001 | Chang et al. | 166/377 |
| 6,408,946 | B1 | * | 6/2002 | Marshall et al. | 166/317 |
| 6,712,146 | B2 | * | 3/2004 | Estep et al. | 166/377 |
| 7,100,696 | B2 | * | 9/2006 | Marshall | 166/377 |
| 7,152,674 | B2 | * | 12/2006 | Bowles | 166/242.6 |
| 7,204,305 | B2 | | 4/2007 | Ricalton et al. | |
| 7,296,639 | B2 | * | 11/2007 | Millar et al. | 175/57 |
| 7,373,974 | B2 | * | 5/2008 | Connell et al. | 166/242.6 |
| 7,380,596 | B2 | | 6/2008 | De Clute-Melancon | |
| 7,431,094 | B2 | | 10/2008 | De Clute-Melancon | |
| 7,681,642 | B2 | * | 3/2010 | Bell et al. | 166/254.2 |
| 8,141,634 | B2 | * | 3/2012 | Fisher et al. | 166/250.13 |
| 8,316,954 | B2 | * | 11/2012 | McGlothen | 166/377 |
| 2005/0029017 | A1 | * | 2/2005 | Berkheimer et al. | 175/320 |
| 2006/0131011 | A1 | | 6/2006 | Lynde et al. | |
| 2007/0034372 | A1 | * | 2/2007 | Moyes | 166/250.1 |
| 2008/0099210 | A1 | * | 5/2008 | Gazewood | 166/377 |
| 2009/0095490 | A1 | | 4/2009 | Moriarty et al. | |
| 2011/0308784 | A1 | | 12/2011 | Ollerenshaw et al. | |

OTHER PUBLICATIONS

Search Report issued Nov. 14, 2012 for International Application PCT/US12/27797, 5 pages.
Written Opinion issued Nov. 14, 2012 for International Application PCT/US12/27797, 4 pages.
Halliburton; "Body Lock Ring", Mechanical Downhole: Technology Transfer, dated Oct. 10, 2001, 4 pages.
International Search Report with Written Opinion issued Nov. 5, 2012 for PCT Patent Application No. PCT/US12/027799, 9 pages.
International Search Report with Written Opinion issued Nov. 14, 2012 for PCT Patent Application No. PCT/US12/027797, 9 pages.
International Search Report with Written Opinion issued Nov. 29, 2012 for PCT Patent Application No. PCT/US12/027803, 9 pages.
Specification and Drawings for U.S. Appl. No. 13/772,044, filed Feb. 20, 2013, 33 pages.
Specification and Drawings for U.S. Appl. No. 13/772,023, filed Feb. 20, 2013, 33 pages.
Halliburton; "Cased Hole", company article pp. 5-7 to 5-38, retrieved Dec. 20, 2011, 32 pages.
Halliburton; "RTTS Safety Joint", Company article H08346, dated Apr. 2011, 2 pages.
Halliburton; "CHAMP IV Non-Rotational Retrievable Packer", Completion Tools article, retrieved Dec. 17, 2011, 1 page.
Halliburton; "Below Packer Hydraulic Safety Joint", company article, retrieved Dec. 17, 2011, 1 page.
Halliburton; "Anchor Pipe Safety Joint", company article, retrieved Oct. 27, 2011, 10 pages.
Office Action issued Sep. 26, 2013 for U.S. Appl. No. 13/975,241, 13 pages.
Office Action issued Jul. 24, 2013 for U.S. Appl. No. 13/772,023, 25 pages.
Office Action issued Nov. 18, 2013 for U.S. Appl. No. 13/772,023, 17 pages.

* cited by examiner

SAFETY JOINT WITH NON-ROTATIONAL ACTUATION

CROSS-REFERENCE TO RELATED APPLICATION

This application claims the benefit under 35 USC §119 of the filing date of International Application Serial No. PCT/US12/27797 filed 6 Mar. 2012. The entire disclosure of this prior application is incorporated herein by this reference.

BACKGROUND

This disclosure relates generally to equipment utilized and operations performed in conjunction with a subterranean well and, in one example described below, more particularly provides a safety joint which is actuated without rotation of a tubular string.

A safety joint is typically interconnected in a tubular string, which is disconnected at the safety joint in the event that a packer, perforating gun or other equipment below the safety joint becomes stuck in a wellbore. After the safety joint is actuated, the tubular string above the safety joint can be readily retrieved from the wellbore.

It will be appreciated that improvements are continually needed in the art of constructing safety joints.

SUMMARY

In this disclosure, systems and methods are provided which bring improvements to the arts of constructing and operating safety joints. One example is described below in which the safety joint is actuated without requiring rotation of a tubular string in which the safety joint is interconnected. Another example is described below in which a safety joint is actuated by partially actuating a jar.

A method of releasing a safety joint in a subterranean well is described below. In one example, the method can comprise disconnecting a tubular string at the safety joint without rotation of the tubular string.

A safety joint for use in a subterranean well is also described below. In one example, sections of the safety joint are separated from each other in response to a predetermined number of relative longitudinal and non-rotational displacements between the sections.

Another method of releasing a safety joint in a subterranean well is described below. In this example, the method can include: fully actuating a jar multiple times, the jar being interconnected in a same tubular string with the safety joint; and then disconnecting the tubular string at the safety joint in response to non-rotational displacement of the tubular string.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
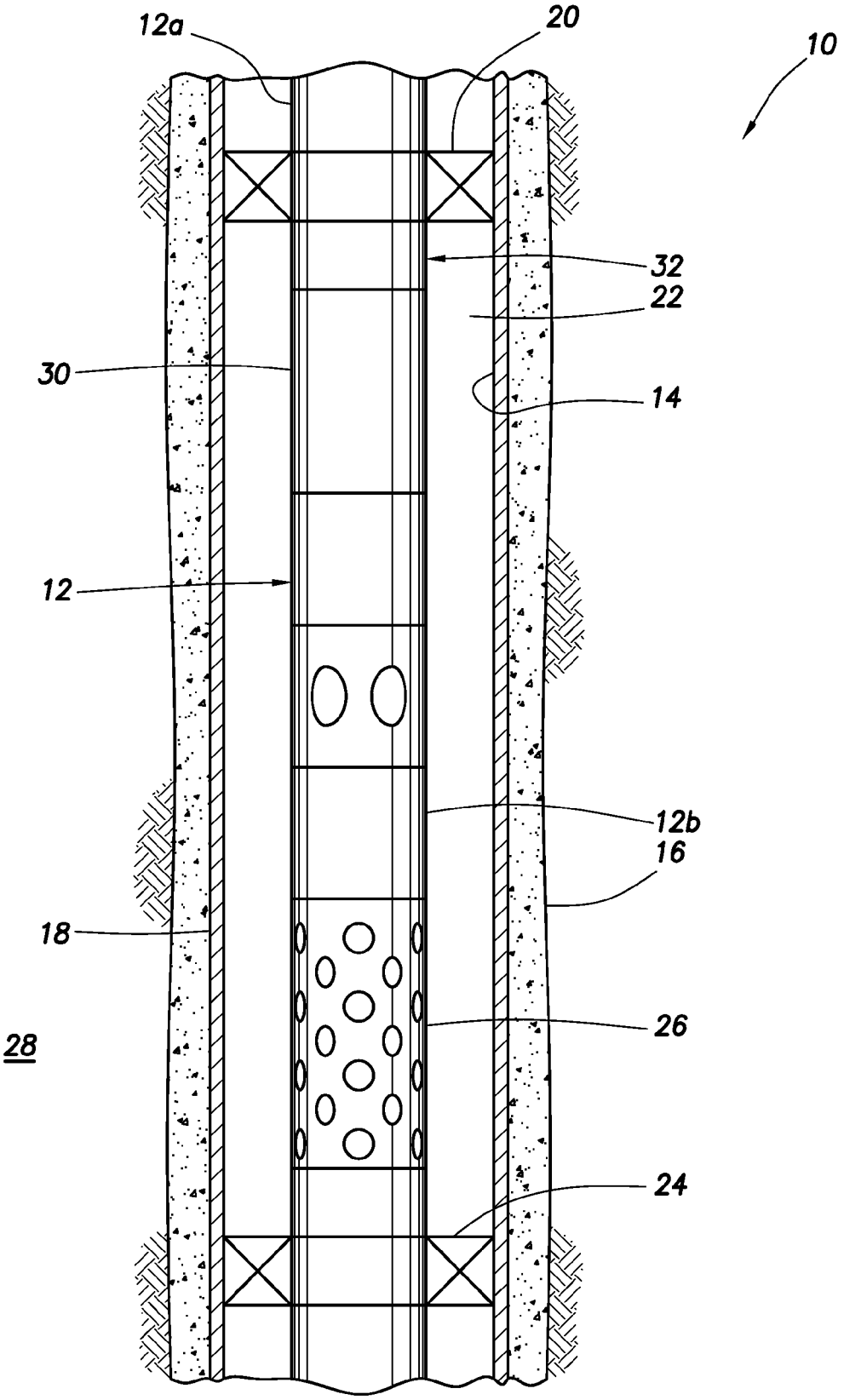
FIG. 1 is a representative partially cross-sectional view of a well system and associated method which can embody principles of this disclosure.

Representatively illustrated in FIG. 1 is a well system 10 and associated method which can embody principles of this disclosure. However, it should be clearly understood that the system 10 and method are merely one example of how the principles of this disclosure can be applied in practice, and so the scope of this disclosure is not limited at all to the details of the system and method as depicted in the drawings and described below.

In the FIG. 1 example, a tubular string 12 is installed in a wellbore 14 lined with cement 16 and casing 18. A packer 20 is set to thereby seal off an annulus 22 formed radially between the tubular string 12 and the wellbore 14. Another packer 24 (or a bridge plug, etc.) may be used if desired to seal off the wellbore 14, so that the annulus 22 is isolated between the packers 20, 24.

The tubular string 12 could be used for any purpose (such as, drill stem testing, completion operations, stimulation operations, etc.). In the depicted example, one or more perforating guns 26 are interconnected in the tubular string 12 for perforating the casing 18 and cement 16, so that fluid can be produced from, or injected into, an earth formation 28 penetrated by the wellbore 14. The formation 28 can then be tested by performing pressure buildup and drawdown tests, in a manner well known to those skilled in the art.

A safety joint 30 is interconnected in the tubular string 12 below the packer 20 (as viewed in FIG. 1). In the event that the packer 24, the perforating gun 26 or another item of equipment below the safety joint 30 becomes stuck or otherwise cannot be readily retrieved from the wellbore 14, the safety joint can be activated to disconnect an upper section 12*a* of the tubular string 12 from a lower section 12*b* of the tubular string, so that the upper section can be retrieved. A separate "fishing" trip can then be used to retrieve the lower section 12*b* of the tubular string 12.

Note that it is not necessary for all of the wellbore 14 to be lined with cement 16 or casing 18, the tubular string 12 could include additional, fewer or different components from those depicted in FIG. 1, the wellbore can be horizontal or inclined, etc. Thus, it will be appreciated that the scope of this disclosure is not limited to the example representatively illustrated in FIG. 1.

A jar 32 (such as a hydraulic or mechanical jar) of the type well known to those skilled in the art is also interconnected in the tubular string 12. Although the jar 32 is depicted in FIG. 1 as being connected below the packer 20, in other examples the jar could be connected above the packer or in another position.

If a hydraulic jar is used, typically the jar is actuated by pulling up on the tubular string 12 above the jar. In tension, the jar will initially meter a hydraulic fluid, and then suddenly release, thereby delivering an upward impact to the tubular string below the jar. After the impact, the jar can be reset by lowering the tubular string above the jar, thereby compressing the jar.

Thus, the jar 32 may be actuated by longitudinal manipulation of the tubular string 12, alternately compressing and elongating the jar. It would be beneficial to be able to actuate the safety joint 30 with longitudinal manipulation of the tubular string 12, for example, in cases where a large umbilical is attached to the tubular string, so that the tubular string does not have to be rotated.

However, the safety joint 30 would preferably be prevented from disconnecting while the jar 32 is being used to deliver impacts to the tubular string 12. In this way, the jar 32 can be used to deliver impacts to the tubular string for freeing stuck equipment and, if use of the jar is unsuccessful, then the safety joint 30 can be disconnected, so that the upper section 12*a* of the tubular string can be retrieved from the well.

Figure 2:
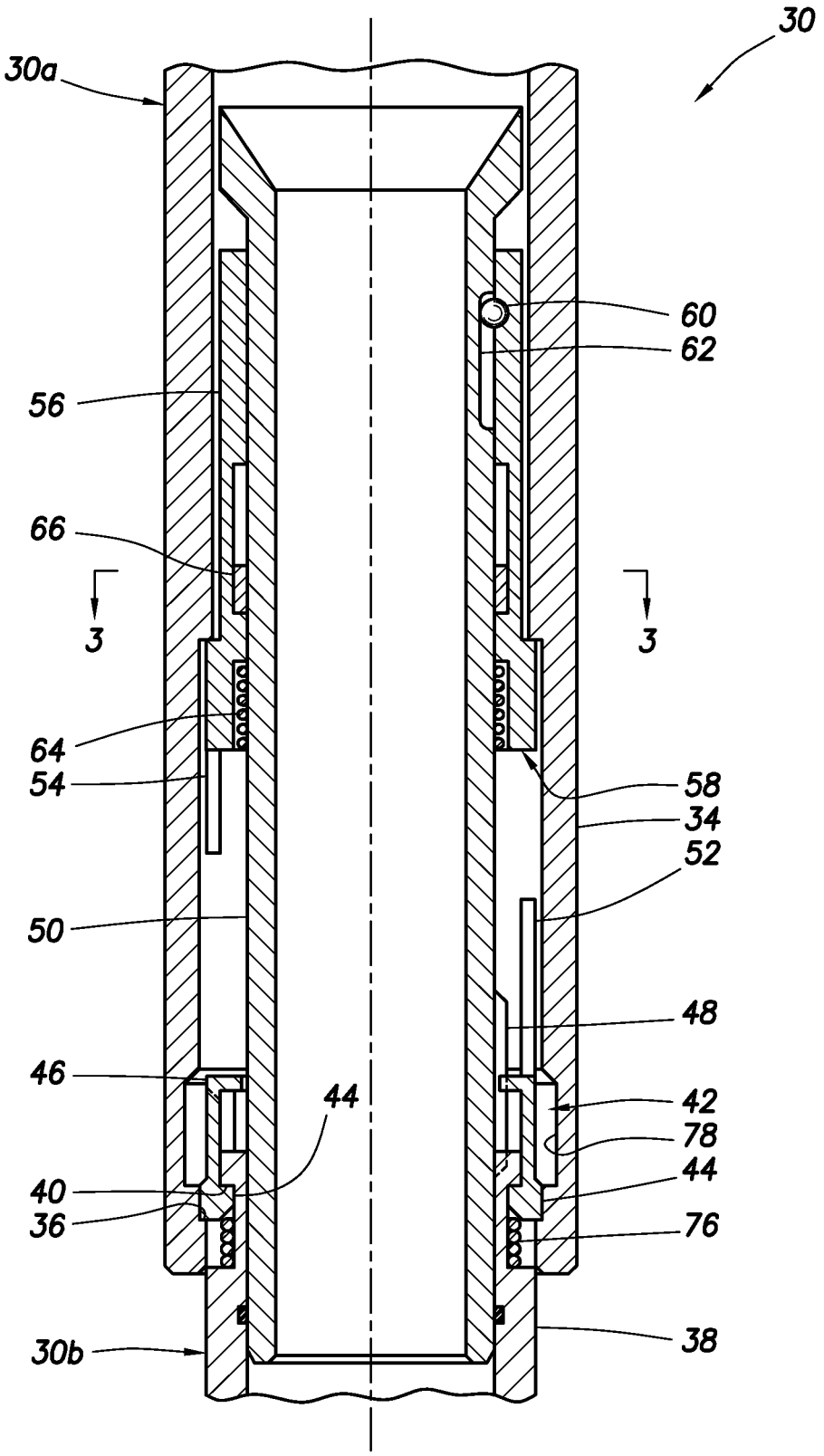
FIG. 2 is a representative cross-sectional view of a safety joint which may be used in the system and method of FIG. 1, and which can embody the principles of this disclosure.

Referring additionally now to FIG. 2, a cross-sectional view of the safety joint 30 is representatively illustrated, apart from the remainder of the FIG. 1 system 10. The safety joint 30 can be used in other well systems and methods, in keeping with the scope of this disclosure.

In the FIG. 2 example, the safety joint 30 includes upper and lower sections 30*a,b* which are disconnected from each other when the safety joint is actuated. The upper and lower sections 30*a,b* may be provided with threaded or other types of connectors for interconnecting the safety joint 30 in the tubular string 12 (e.g., by connecting the safety joint sections 30*a,b* to the respective tubular string sections 12*a,b*).

The upper safety joint section 30*a* includes a generally tubular outer housing 34 having an internal shoulder 36. The lower safety joint section 30*b* includes a generally tubular housing 38 having an external shoulder 40.

A release device 42 includes resilient collets 44 captured between the shoulders 36, 40. This prevents the housings 34, 38 from separating, and allows tensile impacts to be delivered through the safety joint 30, prior to the safety joint being actuated.

Note, however, that the housings 34, 38 can displace toward each other, longitudinally compressing the safety joint 30 somewhat. This longitudinal compression can occur when the jar 32 is being "re-cocked" in preparation for delivering another impact to the tubular string 12.

The safety joint 30 uses this alternating compression and tension in the tubular string 12 (due to actuation of the jar 32) for controlling when the release device 42 is activated to release the upper and lower safety joint sections 30*a,b* for separation. In the FIG. 2 example, the safety joint 30 is disconnected in response to a predetermined number of partial actuations of the jar 32, but the safety joint will not disconnect if the jar is fully actuated. A full actuation of the jar 32 can reset the count of partial actuations, if desired.

In a full actuation of a typical hydraulic jar, tension is applied to a tubular string in which the jar is connected. This tension causes metering of a hydraulic fluid through an orifice, thus producing a time delay. Eventually, the metering is complete, and the jar is allowed to rapidly elongate and then suddenly stop, thereby producing an impact.

In a partial actuation, the tension in the tubular string is not maintained long enough for the impact to be delivered. Instead, the jar is re-cocked prior to the impact being delivered.

If a hydraulic jar is used, then the metering time may be used to determine how to achieve a partial actuation. For example, if the full normal metering time for a particular hydraulic fluid, temperature, tensile force, etc., is 60 seconds, then the tensile force could be applied to the tubular string only 30 seconds for a partial actuation. If another type of jar is used, then other parameters (such as, stroke, rotation, etc.) may be used for determining how to achieve a partial actuation.

In the FIG. 2 release device 42, the collets 44 extend downwardly from a ring 46. The ring 46 is internally slotted, and is longitudinally displaceable on a spline 48 formed externally on a generally tubular mandrel 50.

A single finger 52 extends longitudinally upward from the ring 46. The engagement between the ring 46 and the spline 48 fixes a rotational position of the finger 52 relative to the mandrel 50. A similar finger 54 extends longitudinally downward from a sleeve 56 of a ratchet device 58.

The sleeve 56 is rotatably and longitudinally reciprocably disposed on the mandrel 50. As viewed in FIG. 2, the finger 54 of the ratchet device 58 is not aligned with the finger 52 of the release device 42. However, when the sleeve 56 is rotated about the mandrel 50 sufficiently, the fingers 52, 54 will be aligned, and a next compression of the safety joint 30 (e.g., when re-cocking the jar 32) will cause the release device 42 to release.

Rotation of the sleeve 56 is controlled by engagement of a member 60 in the sleeve with a slot 62 formed in an outer surface of the mandrel 50. The slot 62 can be of the general type referred to by those skilled in the art as a "J" slot. However, additional functionality can be incorporated into the slot 62, so that the ratchet device 58 can be reset, if desired.

A torsion spring 64 biases the sleeve 56 to rotate relative to the mandrel 50. The sleeve 56 can rotate, however, only if the member 60 is in a portion of the slot 62 allowing such rotation.

Also included in the ratchet device 58 is an anti-reverse mechanism 66. The mechanism 66 prevents the sleeve 56 from rotating in a reverse direction while the safety joint 30 is being actuated.

Figure 3:
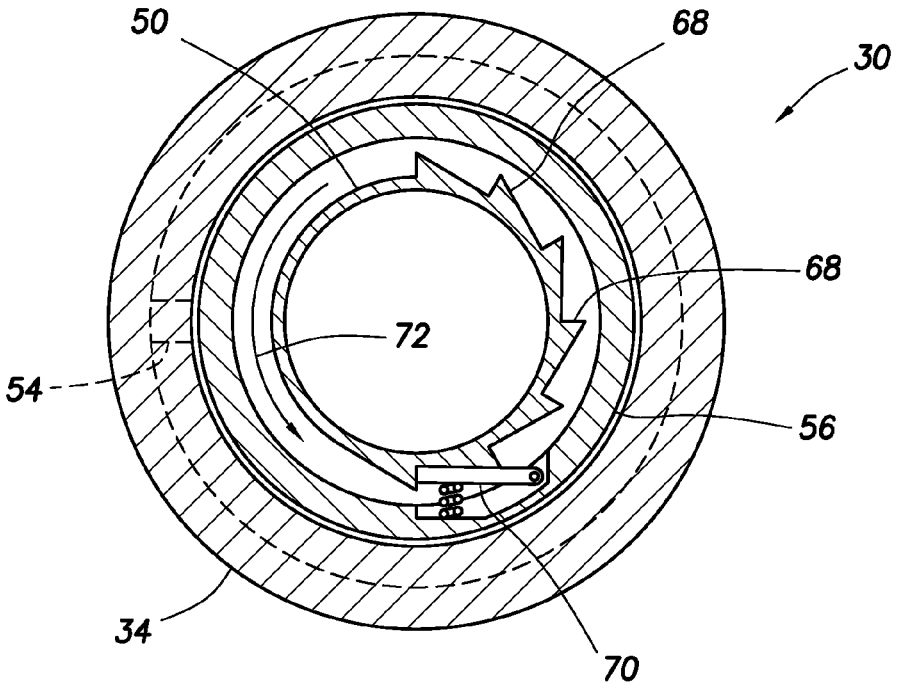
FIG. 3 is a representative cross-sectional view of a rotational anti-reverse device of the safety joint, taken along line 3-3 of FIG. 2.

Referring additionally now to FIG. 3, a further enlarged scale cross-sectional view of the safety joint 30, taken along line 3-3 of FIG. 2, is representatively illustrated. In this view, it may be seen that the mandrel 50 has "teeth" 68 formed at least partially circumferentially around the mandrel. A pawl 70 is carried in the sleeve 56, and is biased into engagement with the teeth 68.

The teeth 68 are shaped so that, when engaged by the pawl 70, a torsional force 72 exerted by the torsion spring 64 is resisted. Thus, the torsion spring 64 will not rotate the sleeve 56 relative to the mandrel 50 when the pawl 70 is engaged with one or more of the teeth 68.

Note that the finger 54 rotates with the sleeve 56 by 180 degrees about the mandrel 50, in order for the fingers 52, 54 to be aligned, and so the teeth 68 also preferably extend at least 180 degrees about the mandrel 50. However, other amounts of rotation may be used, if desired.

Figure 4:
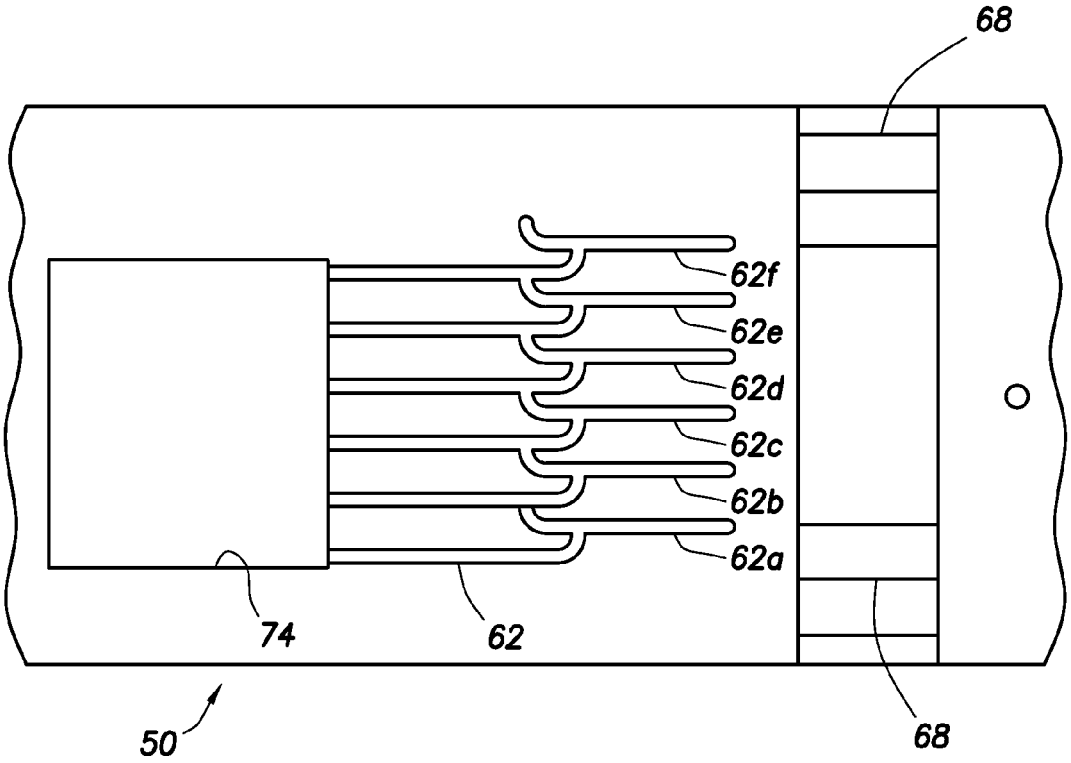
FIG. 4 is a representative "unrolled" view of a mandrel of the safety joint.

Referring additionally now to FIG. 4, an "unrolled" view of an exterior of the mandrel 50 is representatively illustrated. In this view, the manner in which the slot 62 is formed on the exterior of the mandrel 50 can be more clearly seen.

In the FIG. 4 example, six individual "J" slots 62*a-f* are used to correspond to six partial actuations of the jar 32. This means that the sleeve 56 will rotate 30 degrees with each partial actuation, for a total of 180 degrees. However, other numbers of slots and other amounts of rotation may be used, if desired.

Displacement of the member 60 through curved portions of the slot 62 causes the sleeve 56 to rotate relative to the mandrel 50. The anti-reverse mechanism 66 prevents the sleeve 56 from reversing direction, as long as the pawl 70 is engaged with at least one of the teeth 68.

The member 60 is received in the "J" slots 62*a-f* when the jar 32 is partially actuated. However, when the jar 32 has been fully actuated, the member 60 is received in a recess 74 on the mandrel 50, and the pawl 70 does not engage the teeth 68, and so the torsion spring 64 rotates the sleeve 56 relative to the mandrel back to its initial position. This "resets" the ratchet device 58.

If this reset capability is not desired, then the recess 74 can be eliminated. In this configuration (with no recess 74), the safety joint 30 will disconnect after a predetermined number of partial actuations of the jar 32, whether or not there is an intermediate full actuation of the jar.

If the jar 32 is partially actuated multiple times consecutively, the member 60 will progress through the J slots 62*a-f*, causing the sleeve 56 to rotate incrementally about the mandrel 50 with each partial actuation and re-cocking of the jar. Eventually, the sleeve 56 rotates a sufficient amount, thereby aligning the fingers 52, 54.

Figure 5:
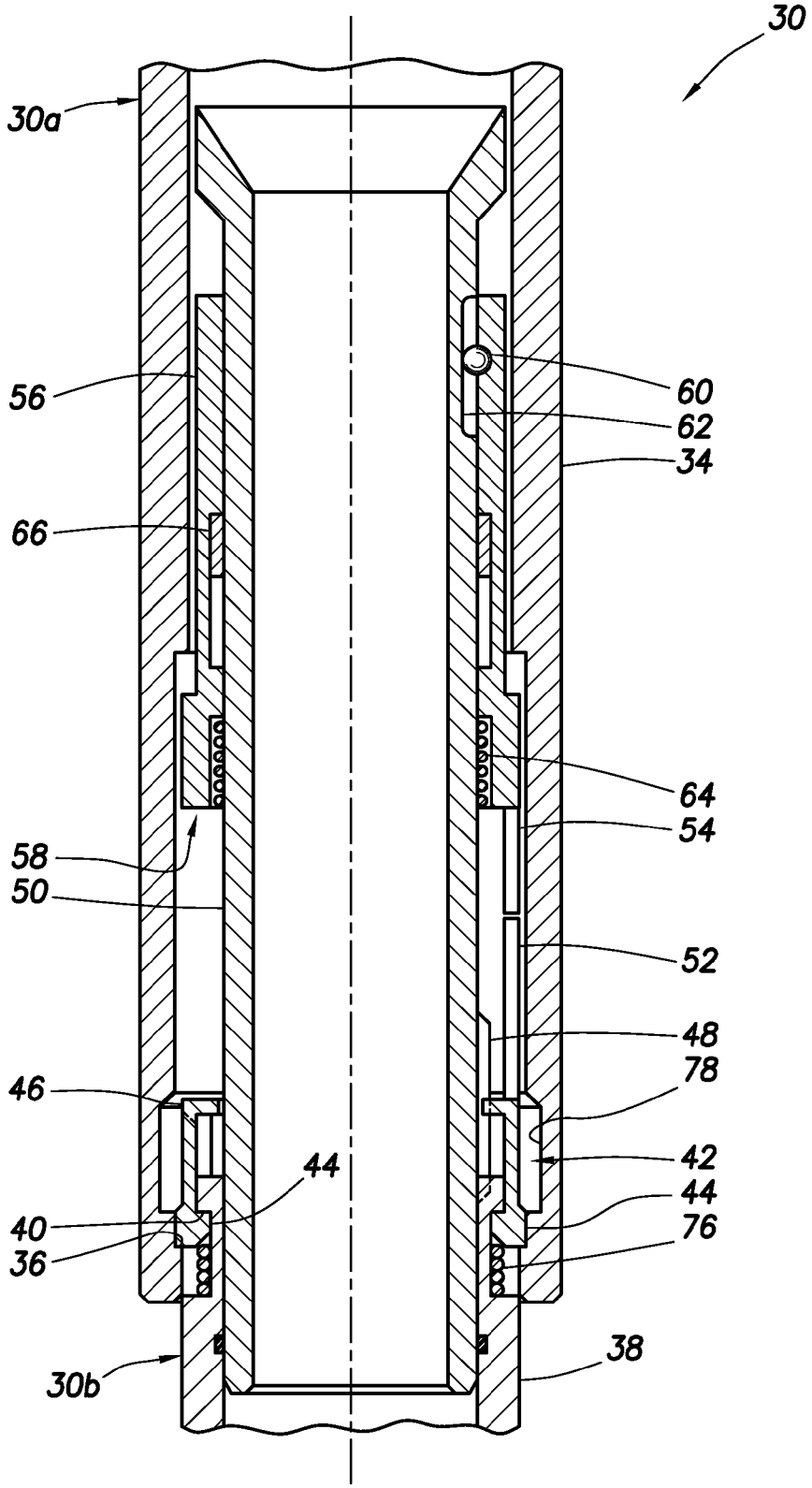
FIG. 5 is a representative cross-sectional view of the safety joint with a release device thereof in an aligned configuration.

Referring additionally now to FIG. 5, the safety joint 30 is representatively illustrated after the sleeve 56 has rotated, and the fingers 52, 54 are rotationally aligned. On a next re-cocking of the jar 32 (e.g., when the tubular string 12 is compressed), this alignment of the fingers 52, 54 will allow the release device 42 to be released.

Figure 6:
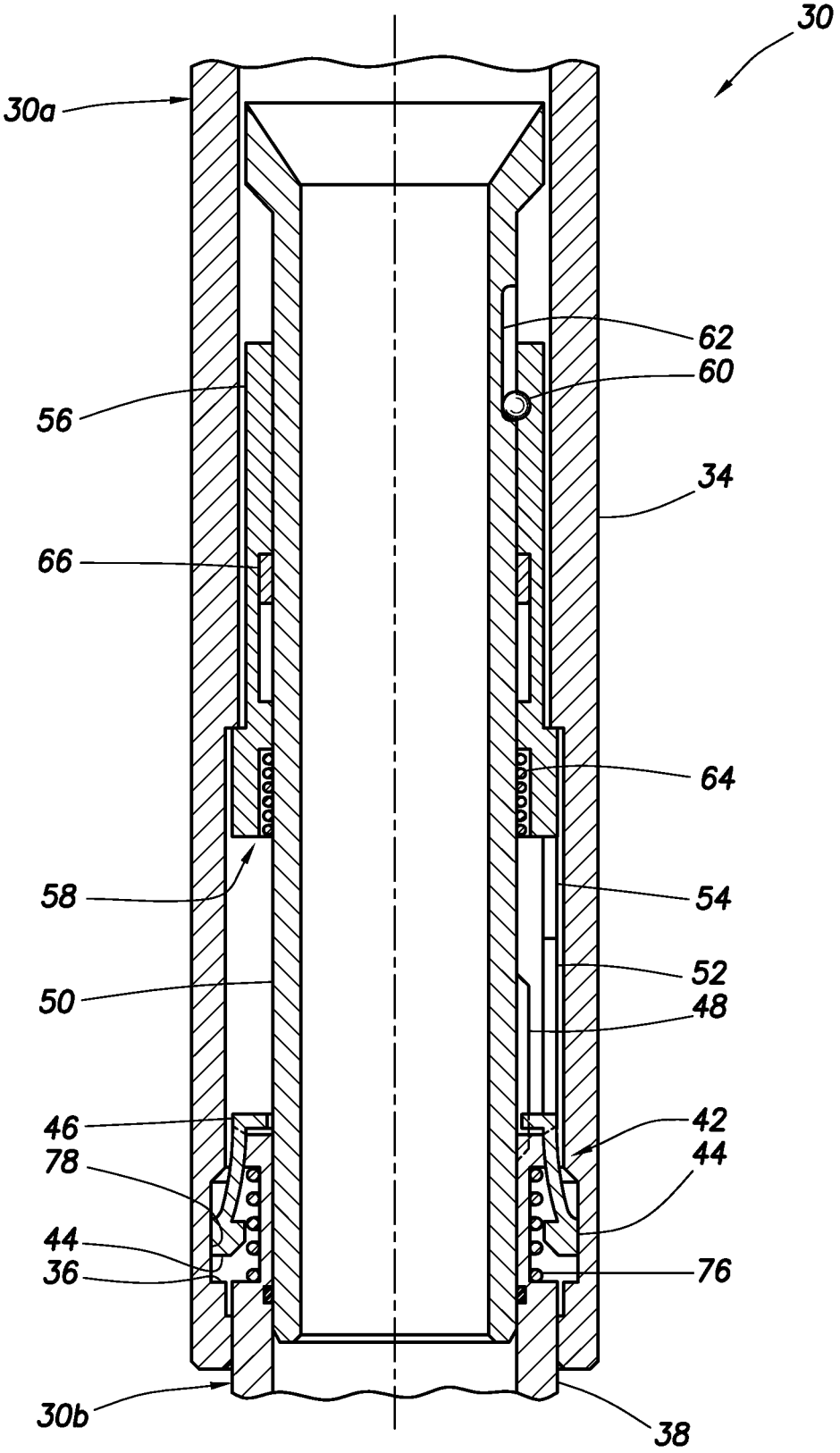
FIG. 6 is a representative cross-sectional view of the safety joint in a released configuration.

Referring additionally now to FIG. 6, the safety joint 30 is representatively illustrated with the release device 42 released. Compression of the safety joint 30 displaces the outer housing 34 downward relative to the housing 38, causing the finger 54 to push downward on the finger 52. This causes the collets 44 to ride up and over a compression spring 76 carried on the housing 38.

The spring 76 prevents the collets 44 from retracting radially inward. The collets 44, thus, remain radially outwardly extended into an annular recess 78 formed in the outer housing 34.

When the safety joint upper section 30*a* is next displaced upward (e.g., when the tubular string section 12*a* is raised from the surface), the outer housing 34, collets 44, mandrel 50, ratchet device 58 and the remainder of the upper section 30*a* can be retrieved from the well, separate from the lower section 30*b*. With the collets 44 maintained in their radially outward positions, they cannot be captured between the shoulders 36, 40 again.

Although a particular type of ratchet device 58 and a particular type of release device 42 are described above, it will be appreciated that a wide variety of different types of devices may be used. The release device 42 and ratchet device 58 are merely examples of ways in which the safety joint 30 can be disconnected, without requiring rotation of the tubular string 12.

It may now be fully appreciated that the above disclosure provides significant advancements to the art of constructing and operating safety joints in wells. In examples described above, the safety joint 30 can be disconnected with longitudinal manipulation of the tubular string 12, whether or not the jar 32 is also used to deliver impacts to the tubular string.

The above disclosure provides to the art a method of releasing a safety joint 30 in a subterranean well. In one example, the method can include disconnecting a tubular string 12 at the safety joint 30 without rotation of the tubular string 12.

The disconnecting can comprise manipulating the tubular string 12, thereby causing relative longitudinal displacement between first and second sections 30*a,b* of the safety joint 30. The relative longitudinal displacement between the first and second safety joint sections 30*a,b* may operate a ratchet device 58.

The method can also include actuating a jar 32 multiple times prior to disconnecting the safety joint 30. The disconnecting may be performed in response to partially actuating a jar 32 a predetermined number of times. Fully actuating the jar 32 can restart a count of the partially actuating the jar 32 step.

The disconnecting may comprise aligning a portion (e.g., finger 54) of a ratchet device 58 with a portion (e.g., finger 52) of a release device 42, whereby the release device 42 releases in response to non-rotational displacement of the tubular string 12 when the release device portion is aligned with the ratchet device portion.

Also described above is a safety joint 30 for use in a subterranean well. In one example, the safety joint 30 can include first and second sections 30*a,b* which are separated from each other in response to a predetermined number of relative longitudinal and non-rotational displacements between the first and second safety joint sections 30*a,b*.

The safety joint 30 may include a ratchet device 58 with a portion (e.g., finger 54) thereof which is displaced in response to the relative longitudinal and non-rotational displacements between the first and second safety joint sections 30*a,b*.

The safety joint 30 can also include a release device 42 which releases the first and second safety joint sections 30*a,b* from each other in response to one of the relative longitudinal and non-rotational displacements when the ratchet device 58 portion (e.g., finger 54) is aligned with a portion (e.g., finger 52) of the release device 42.

The ratchet device portion may be rotated in response to the relative longitudinal and non-rotational displacements between the first and second safety joint sections 30*a,b*.

The relative longitudinal and non-rotational displacements can comprise partial actuations of a jar 32. Full actuation of the jar 32 may reset the number of relative longitudinal and non-rotational displacements.

Another method of releasing a safety joint 30 in a subterranean well is described above. The method may include fully actuating a jar 32 multiple times, the jar 32 being interconnected in a same tubular string 12 with the safety joint 30; and then disconnecting the tubular string 12 at the safety joint 30 in response to non-rotational displacement of the tubular string 12. The disconnecting can include releasing a set of collets 44.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A method of releasing a safety joint in a subterranean well, the method comprising:

disconnecting a tubular string at the safety joint without rotation of the tubular string, wherein the disconnecting comprises manipulating the tubular string, thereby causing relative longitudinal displacement between first and second sections of the safety joint, wherein the relative longitudinal displacement between the first and second safety joint sections operates a ratchet device, and wherein the relative longitudinal displacement is caused by partially actuating a jar a predetermined number of times without delivering an impact to a tubular string.

2. A method of releasing a safety joint in a subterranean well, the method comprising:

disconnecting a tubular string at the safety joint without rotation of the tubular string, wherein the disconnecting is performed in response to partially actuating a jar a predetermined number of times without delivering an impact to the tubular string.

3. The method of claim 2, wherein fully actuating the jar restarts a count of how many times the jar is partially actuated.

4. A method of releasing a safety joint in a subterranean well, the method comprising:

disconnecting a tubular string at the safety joint without rotation of the tubular string, wherein the disconnecting comprises aligning a portion of a ratchet device with a portion of a release device, whereby the release device releases in response to non-rotational displacement of the tubular string when the release device portion is aligned with the ratchet device portion, wherein the non-rotational displacement is caused by partially actuating a jar a predetermined number of times without delivering an impact to a tubular string.

5. A safety joint for use in a subterranean well, the safety joint comprising:

first and second sections, wherein the first and second sections are separated from each other in response to a predetermined number of relative longitudinal and non-rotational displacements between the first and second safety joint sections; and a ratchet device that responds to the displacements, wherein the relative longitudinal and non-rotational displacements comprise partial actuations of a jar without delivering an impact to the tubular string.

6. The safety joint of claim 5, wherein a portion of the ratchet device is displaced in response to the relative longitudinal and non-rotational displacements between the first and second safety joint sections.

7. The safety joint of claim 6, further comprising a release device which releases the first and second safety joint sections from each other in response to one of the relative longitudinal and non-rotational displacements when the ratchet device portion is aligned with a portion of the release device.

8. The safety joint of claim 6, wherein the ratchet device portion is rotated in response to the relative longitudinal and non-rotational displacements between the first and second safety joint sections.

9. The safety joint of claim 5, wherein a full actuation of the jar resets the number of relative longitudinal and non-rotational displacements.

10. A method of releasing a safety joint in a subterranean well, the method comprising:

fully actuating a jar multiple times, the jar being interconnected in a same tubular string with the safety joint, wherein the safety joint will not disconnect if the jar is fully actuated; and then disconnecting the tubular string at the safety joint in response to partially actuating the jar a predetermined number of times without delivering an impact to the tubular string.

11. The method of claim 10, wherein the disconnecting comprises manipulating the tubular string, thereby causing relative longitudinal displacement between first and second sections of the safety joint.

12. The method of claim 11, wherein the relative longitudinal displacement between the first and second safety joint sections operates a ratchet device.

13. The method of claim 10, further comprising fully actuating the jar after partially actuating the jar less than the predetermined number of times, thereby restarting a count of how many times the jar is partially actuated.

14. The method of claim 10, wherein the disconnecting comprises aligning a portion of a ratchet device with a portion of a release device, whereby the release device releases in response to the non-rotational displacement of the tubular string when the release device portion is aligned with the ratchet device portion.

15. The method of claim 10, wherein the disconnecting further comprises releasing a set of collets.

* * * * *